US007895668B2

(12) United States Patent
Tinecheff

(10) Patent No.: US 7,895,668 B2
(45) Date of Patent: Mar. 1, 2011

(54) NURSING APRON

(75) Inventor: Bree Tinecheff, Canning Vale (AU)

(73) Assignee: Easy Feed Pty Ltd, Canning Vale, Western Australia (AU)

( * ) Notice: Subject to any disclaimer, the term of this patent is extended or adjusted under 35 U.S.C. 154(b) by 166 days.

(21) Appl. No.: 12/160,591

(22) PCT Filed: Dec. 22, 2006

(86) PCT No.: PCT/AU2006/001991

§ 371 (c)(1),
(2), (4) Date: Sep. 16, 2008

(87) PCT Pub. No.: WO2007/079523

PCT Pub. Date: Jul. 19, 2007

(65) Prior Publication Data

US 2010/0162460 A1 Jul. 1, 2010

(30) Foreign Application Priority Data

Jan. 12, 2006 (AU) ..... 2006100029

(51) Int. Cl.
*A41D 1/20* (2006.01)

(52) U.S. Cl. ..... 2/104; 2/88

(58) Field of Classification Search ..... 2/48, 2/51, 52, 104, 114, 88, 83, 50, 49.1, 207, 2/102, 106
See application file for complete search history.

(56) References Cited

U.S. PATENT DOCUMENTS 2,417,888 A * 3/1947 Schuster ..... 2/104
2,691,167 A * 10/1954 Oakvik ..... 2/50
4,280,227 A * 7/1981 Brock ..... 2/88
4,567,611 A 2/1986 Kendrick
4,712,251 A 12/1987 Cobble
4,771,480 A * 9/1988 Stimson et al. ..... 2/88
4,797,953 A * 1/1989 Dameron ..... 2/104
4,987,612 A * 1/1991 Middleton ..... 2/104
4,995,116 A * 2/1991 Beauchamp et al. ..... 2/104
5,005,217 A * 4/1991 Bern et al. ..... 2/104
5,848,439 A * 12/1998 Huseth et al. ..... 2/104
6,301,713 B1 10/2001 Aceves
2003/0135909 A1 7/2003 Latorre

FOREIGN PATENT DOCUMENTS

DE 29517798 4/1996

* cited by examiner

*Primary Examiner*—Amy B Vanatta
(74) *Attorney, Agent, or Firm*—Davis Wright Tremaine LLP; George C. Rondeau, Jr.

(57) ABSTRACT

A nursing apron for a breastfeeding mother is disclosed. The apron comprises a blanket of sufficiently large size to wrap around an upper portion of the mother's torso, and fixing means arranged so as to retain the blanket around the mother's torso. The fixing means includes first fixing means attached to the blanket at a first end portion of the blanket, and second fixing means attached to the blanket at a second end portion of the blanket. The locations of the first and second fixing means is such that the first and second ends overlap to a sufficient degree during use that the mother's breasts are not exposed whilst the mother is breastfeeding a baby.

5 Claims, 1 Drawing Sheet

NURSING APRON

FIELD OF THE INVENTION

The present invention relates to a nursing apron for a breastfeeding mother.

BACKGROUND OF THE INVENTION

It is known to provide a nursing apron of the type which includes a blanket and fixing means arranged to fix ends of the blanket to each other when the blanket is wrapped around a mother's upper torso. However, such a nursing apron often results in breasts of the mother being at least partially exposed.

SUMMARY OF THE INVENTION

In accordance with a first aspect of the present invention, there is provided a nursing apron for a breastfeeding mother, said apron comprising:

a blanket of sufficiently large size to wrap around an upper portion of the mother's torso whilst the mother is breastfeeding a baby; and fixing means arranged so as to retain the blanket around the mother's torso;

the fixing means including the first fixing means disposeed on the blanket at a first end portion of the blanket, and the complementary second fixing means disposed on the blanket at second end portion of the blanket and engageable with the first fixing means, the locations of the first and second fixing means being such that when the first and second fixing means are engaged to each other, the first and second end portions overlap to a sufficient degree during use that a substantial portion of the mother's upper torso including the mother's breasts are not exposed whilst the mother is breastfeeding a baby.

In one arrangement, the first fixing means is disposed immediately adjacent a first inner edge of the blanket, and the second fixing means is spaced from a second inner edge of the blanket by a sufficient distance so that the first and second end portions overlap when the first fixing means is engaged with the second fixing means.

In one embodiment, the blanket includes a neck portion disposable adjacent a neck of a mother during use, and the fixing means are remotely disposed relative to the neck portion such that during use when the first fixing means is engaged with the second fixing means, the blanket is loosely disposed relative to a neck of the mother so that the mother is able to see the baby whilst the baby is breastfeeding. The fixing means may be disposed substantially centrally relative to the first and second end portions.

The blanket may be of generally U-shaped configuration and may include a cut out portion defined by the neck portion and the first and second edges, the cut out portion being of sufficient size to receive a neck of a mother during use.

In one arrangement, the fixing means comprises first and second complimentary press stud portions, a hook/eye fixing device, or any other suitable fixing device capable of securely fixing ends of the blanket together in a releasable way.

The blanket may be formed of polycotton material, cotton material, or any other suitable opaque or translucent material.

The blanket may also include a bias binding which may be in the form of piping, the bias binding serving to assist in maintaining the shape of the blanket during use and during washing.

BRIEF DESCRIPTION OF THE DRAWINGS

The present invention will now be described, by way of example only, with reference to the accompanying drawings, in which.

DESCRIPTION OF AN EMBODIMENT OF THE PRESENT INVENTION

Figure 1:
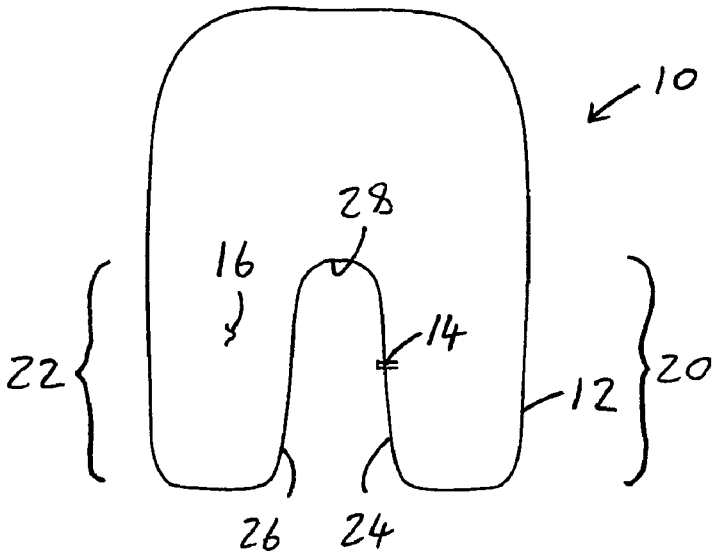
FIG. 1 is a diagrammatic plan view of a nursing apron in accordance with an embodiment of the present invention.
Figure 2:
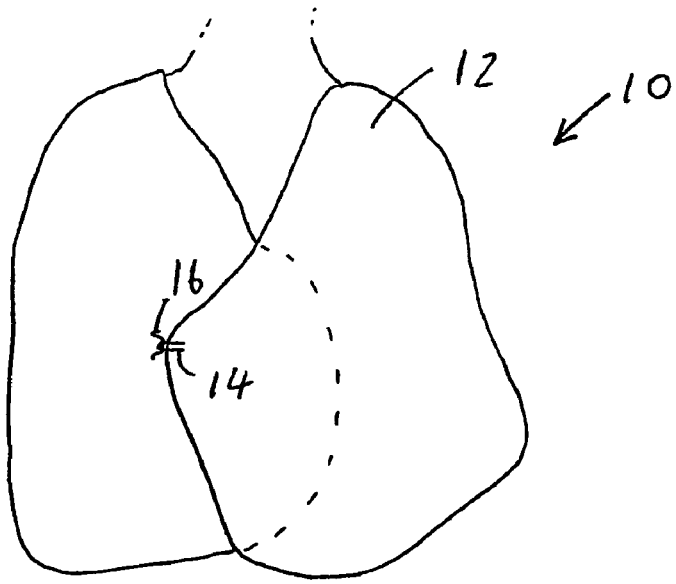
FIG. 2 is a diagrammatic view of the nursing apron shown during use wrapped around an upper torso of a mother.

Referring to the drawings, there is shown a nursing apron 10 which includes a blanket 12, in this example of generally U-shaped configuration, and fixing means for fixing the blanket 12 in position around an upper torso of a breastfeeding mother during use.

In the present example, the blanket is formed of polycotton or cotton material, although it will be understood that any suitable opaque or translucent material is envisaged.

The fixing means is in the form of first fixing means 14 attached to the blanket 12 at a first end portion 20 of the blanket, and second complementary fixing means 16 attached to the blanket 12 at a second end portion 22 of the blanket. The first and second fixing means are attached to the blanket at locations such that during use, when the blanket is wrapped around a breastfeeding mother and the first and second fixing means are engaged with each other, the first and second end portions 20, 22 of the blanket overlap by a sufficient distance so that during use the mother's breasts are not exposed. For this purpose, the first fixing means 14 is disposed immediately adjacent an inner edge 24 of the blanket 12, and the second fixing means 16 is disposed at a location spaced from a second inner edge 26 of the blanket.

In this example, the fixing means comprises a hook portion 14 and an eye portion 16, although it will be understood that other suitable fixing means are envisaged, such as complimentary press stud portions.

The first and second fixing means 14, 16 are disposed generally centrally relative to first and second end portions 20, 22. By disposing the first and second fixing means 14, 16 remotely relative to a neck region 28 of the blanket in this way, it will be understood that, during use, when the first and second fixing means are engaged with each other the blanket 12 is loosely disposed relative to a neck of a breastfeeding mother so that the mother is able to see her baby whilst the baby is breastfeeding.

In this example, the blanket is provided with a bias binding in the form of piping (not shown) which extends around a periphery of the blanket 12. The piping serves to assist in maintaining the shape of the blanket during use and during washing.

During use, prior to commencing breastfeeding, a mother first wraps the blanket around her upper torso such that the neck region 28 is adjacent a rearwardly facing part of the mother's neck and the first and second end portions 20, 22 are at the front. The mother then uses the fixing means to fix the blanket together. Since the first and second end portions 20, 22 overlap to a significant degree, no gaps are present between the first and second end portions 20, 22 at a region adjacent the mother's breasts and the mother's breasts are not exposed whilst breastfeeding.

It will also be understood that although the mothers breast's are not exposed during breastfeeding, the mother is nevertheless able to see her baby because the blanket 12 is relatively loosely held around the mothers neck.

Modifications and variations as would be apparent to a skilled addressee are deemed to be within the scope of the present invention.

The invention claimed is:

1. A nursing apron for a breastfeeding mother, said apron comprising:

a substantially U-shaped blanket of sufficiently large size to wrap around an upper portion of the mother's torso, the blanket having first and second end portions defining legs of the U; and fixing means arranged so as to retain the blanket around the mother's torso;

the fixing means including first fixing means disposed on the blanket at the first end portion, and complementary second fixing means disposed on the blanket at the second end portion and engageable with the first fixing means;

wherein the first fixing means is disposed adjacent a first inner edge of the first end portion, and the second fixing means is spaced from a second inner edge of the second end portion by a sufficient distance so that the first and second end portions overlap when the first fixing means is engaged with the second fixing means to a sufficient degree during use that the mother's breasts are not exposed whilst the mother is breastfeeding a baby; and wherein the blanket includes a neck portion disposable adjacent a neck of a mother during use, the fixing means being remotely disposed relative to the neck portion such that during use when the first fixing means is engaged with the second fixing means, a blanket portion is defined between the fixing means and the neck portion which is loosely disposed.

2. The nursing apron as claimed in claim 1, wherein the fixing means comprises first and second complementary press stud portions.

3. The nursing apron as claimed in claim 1, wherein the first fixing means comprises a hook portion and the second fixing means comprises an eye portion.

4. The nursing apron as claimed in claim 1, wherein the blanket is formed of opaque material.

5. The nursing apron as claimed in claim 1, further comprising a bias binding which serves to assist in maintaining the shape of the blanket during use.

* * * * *